US006612371B2

(12) United States Patent
McIntosh et al.

(10) Patent No.: US 6,612,371 B2
(45) Date of Patent: Sep. 2, 2003

(54) WELLHEAD SYSTEM COMPRISING A SLIDING SLEEVE SEAL

(75) Inventors: Gavin J. McIntosh, Edinburgh (GB); Roberto L. Quoiani, Dunfermline (GB)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 09/998,254

(22) Filed: Nov. 29, 2001

(65) Prior Publication Data

US 2002/0074126 A1 Jun. 20, 2002

(30) Foreign Application Priority Data

Dec. 20, 2000 (GB) ..... 0031153

(51) Int. Cl.[7] ..... E21B 33/043

(52) U.S. Cl. ..... 166/368; 166/88.1; 166/82.1; 166/191

(58) Field of Search ..... 166/368, 382, 166/387, 86.1, 88.1, 82.1, 334.4, 191

(56) References Cited

U.S. PATENT DOCUMENTS 3,662,822 A * 5/1972 Wakefield
4,407,363 A * 10/1983 Akkerman
4,471,965 A * 9/1984 Jennings et al.
4,623,020 A * 11/1986 Nichols
5,749,608 A * 5/1998 Wilkins et al.
6,050,339 A 4/2000 Milberger
6,062,314 A 5/2000 Nobileau
2002/0011336 A1 1/2002 Baskett et al.

FOREIGN PATENT DOCUMENTS

EP 0 719 905 A1 7/1996
WO WO01/55550 A1 8/2001

* cited by examiner

*Primary Examiner*—Roger Schoeppel
(74) *Attorney, Agent, or Firm*—Henry C. Query, Jr.

(57) ABSTRACT

The present invention is directed to a sealing sleeve which is disposed in a lateral fluid conduit that extends at least partially through a tubing hanger and a surrounding spool and which is slideable between a retracted position for running and retrieval of the tubing hanger and an extended position for sealing across the interface between the tubing hanger and the spool.

7 Claims, 3 Drawing Sheets

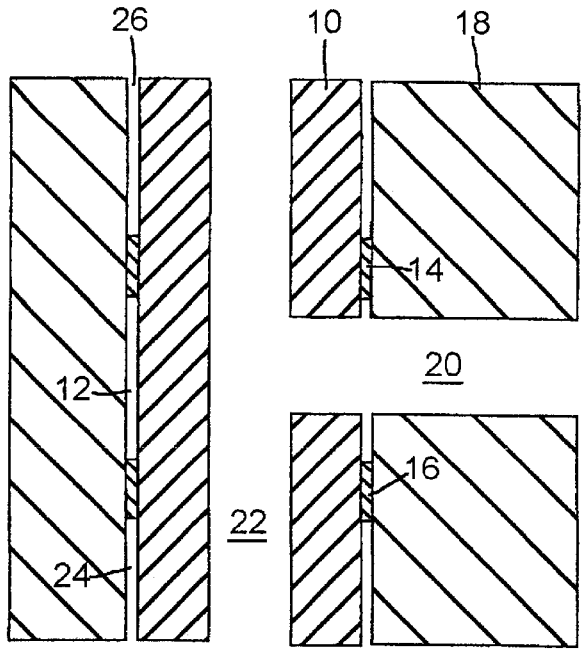
Fig. 1
(prior art)
Fig. 2a
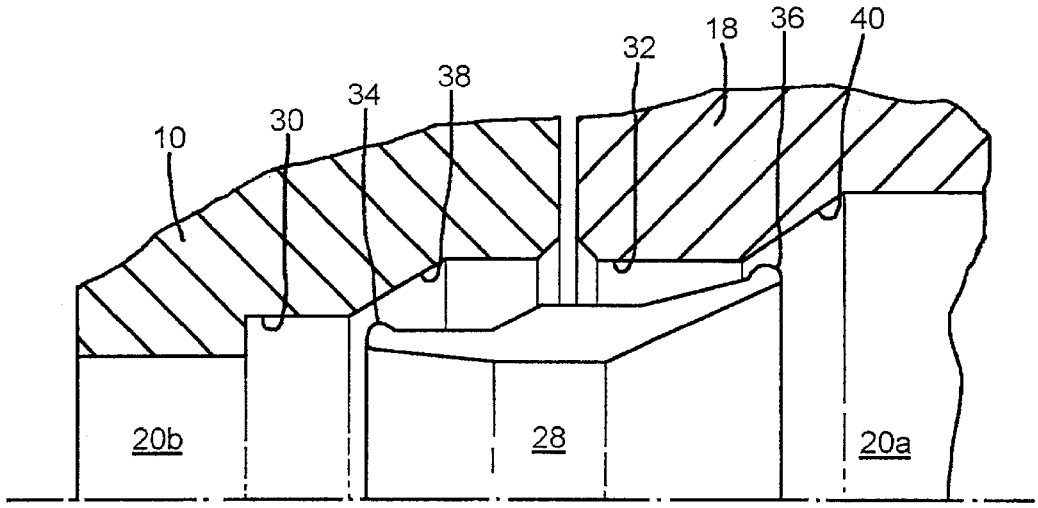

WELLHEAD SYSTEM COMPRISING A SLIDING SLEEVE SEAL

BACKGROUND OF THE INVENTION

This invention relates to sealing of the annulus between a tubing hanger and a surrounding spool such as an xmas tree, in a wellhead assembly having a laterally extending fluid conduit. For example, the laterally extending conduit may comprise the production outlet of a horizontal xmas tree.

There is a trend towards subsea completions incorporating increasingly large bores. Current subsea xmas tree system configurations (both parallel and concentric) can be inefficient in terms of space usage within the tubing hanger assembly. For large bore systems it would be advantageous to reconfigure the subsea xmas tree system whilst maintaining a large number of down-hole lines through the tubing hanger. A solution for releasing additional radial space to facilitate larger bores would be to reduce the size of the mechanism for sealing off the annulus void.

The design of large bore subsea xmas tree s and completions is constrained due to requirement s of utilizing existing standard BOP configurations. Therefore in order to run larger completion tubing, space must be saved elsewhere to permit using existing BOP's. Additionally, particularly in the case of deepwater developments, significant cost savings can be achieved by using smaller standard BOP and casing programs while still maintaining—or increasing—the radial space available for the completion tubing. In this way vessel selection is made easier, and hence costs decreased, due to smaller handling requirements associated with the smaller BOP size.

The problematic situation of a drive toward larger bore completions coupled with potentially utilizing smaller BOP stacks makes the radial space taken within the well system for annular packoffs of prime importance. Any space saved here can have a direct impact on the size of the completion tubing that can be accommodated.

Essentially, the sealing requirement for a slick bore tubing hanger is to seal the annulus between the tubing hanger and spool (wellhead, xmas tree or tubing spool), maintaining a clearance while running in the hanger, and once the hanger is in position, setting the seal to a sealed condition. In the particular case of horizontal production outlet tubing hangers, it is usual to seal the annulus above and below the horizontal outlet. In the case of conventional tubing hangers (or casing hangers), only one seal barrier is required to seal off the annulus.

SUMMARY OF THE INVENTION

The present invention aims to release additional space in a tubing hanger and wellhead system incorporating a lateral wellbore fluid conduit by improving the mechanism for sealing off the annulus void. In this way, larger bore completion tubing can be accommodated. Accordingly the present invention provides a wellhead system comprising a wellbore fluid conduit extending laterally between a tubing hanger and a surrounding spool in use, the system comprising a sleeve slideable axially of the wellbore fluid conduit from a position in which it is clear of the tubing hanger/spool interface to a position in which it seals across the tubing hanger/spool interface. Therefore, with the sleeve positioned clear of the tubing hanger/spool interface, the tubing hanger and attached completion tubing may be run or retrieved. As it is capable of sealing across this interface, the sleeve eliminates the need for the relatively bulky annulus seals and their energizing mechanisms above and below the laterally extending wellbore fluid conduit.

This provides the dual benefits of releasing radial space while also making the completion system and in particular its seal-forming surfaces or areas less susceptible to damage. Preferably, the spool is provided with recessed sealing profiles affording protection to the seal areas during drilling operations.

The laterally extending wellbore fluid conduit may be used to contain any fluid that is conventionally conveyed to or from the wellbore via the tubing hanger. Most often in production mode this will be production fluid, but the fluid could also be for example lift gas, injection water or other fluids such as glycol for chemical injection, or fluids for pressure and circulation testing.

The wellhead sealing system of the present invention may provide some or all of the following additional benefits:

1. Reliability under cyclical loading.
2. Ability to be remotely operated using simple tooling.
3. Ability to accommodate 10,000 psi (69 $MNm^{-2}$) nominal maximum working pressure as a base case. However a family of such sealing systems may be produced, also including, for example, members for 5,000 psi (35 $MNm^{-2}$), 15,000 psi (104 $MNm^{-2}$) and other duties as required.
4. Minimum temperature range of 0 to 250° F. (−17.8° C. to 121° C.), and preferably beyond at either end.

These and other objects and advantages of the present invention will be made apparent from the following detailed description, with reference to the accompanying drawings.

BRIEF DESCRIPTION OF THE DRAWINGS

FIG. 1 is a diagrammatic illustration of a prior art sealing arrangement between a horizontal xmas tree and a tubing hanger landed in the xmas tree;

FIG. 2*a* is a half section through parts of the spool, tubing hanger and sleeve, showing details of possible sealing arrangements;

DETAILED DESCRIPTION OF THE PREFERRED EMBODIMENTS

Figure 2:
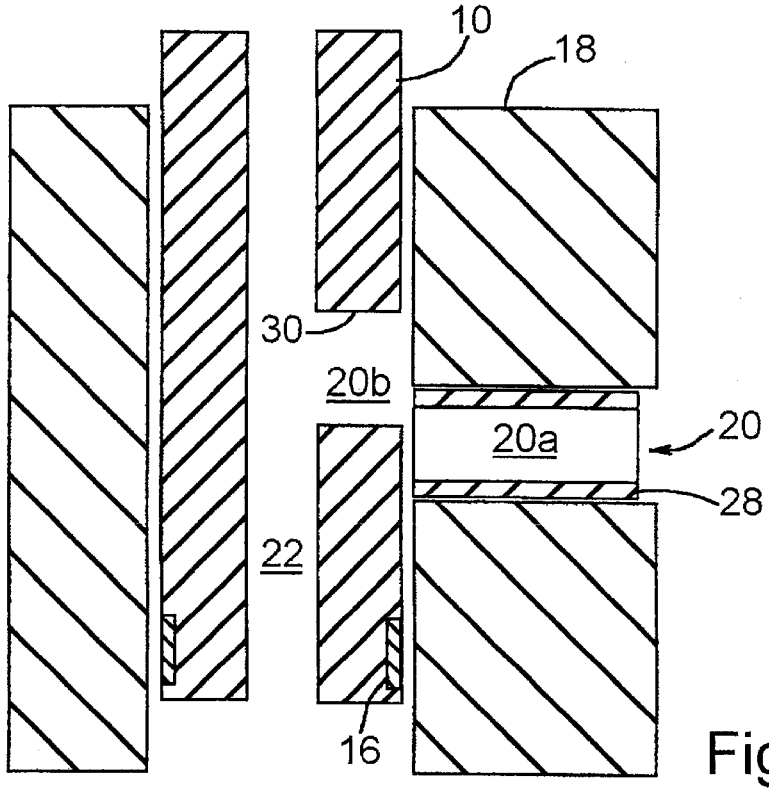
FIG. 2 is a diagram of a first embodiment of the invention, showing the tubing hanger just prior to landing in a spool.

For horizontal xmas trees, it is conventional to isolate the annulus 12 surrounding the tubing hanger 10 using annular seals 14, 16 installed between the tubing hanger 10 and the surrounding tree block 18 above and below the production outlet 20, as shown in FIG. 1. The lower seal 16 isolates fluid in the production bore 22 and production outlet 20 from the well annulus 24 below. Similarly, the upper seal 14 isolates the outlet 20 and bore 22 from the annulus 26 above.

The illustrated embodiments of the invention seek to eliminate one of these annular seals (either the top or the bottom seal can be eliminated, although for brevity FIGS. 2–5 only show elimination of the top seal). Elimination of a seal set will free radial space, while making the completion less susceptible to damage during drilling.

Figure 3:
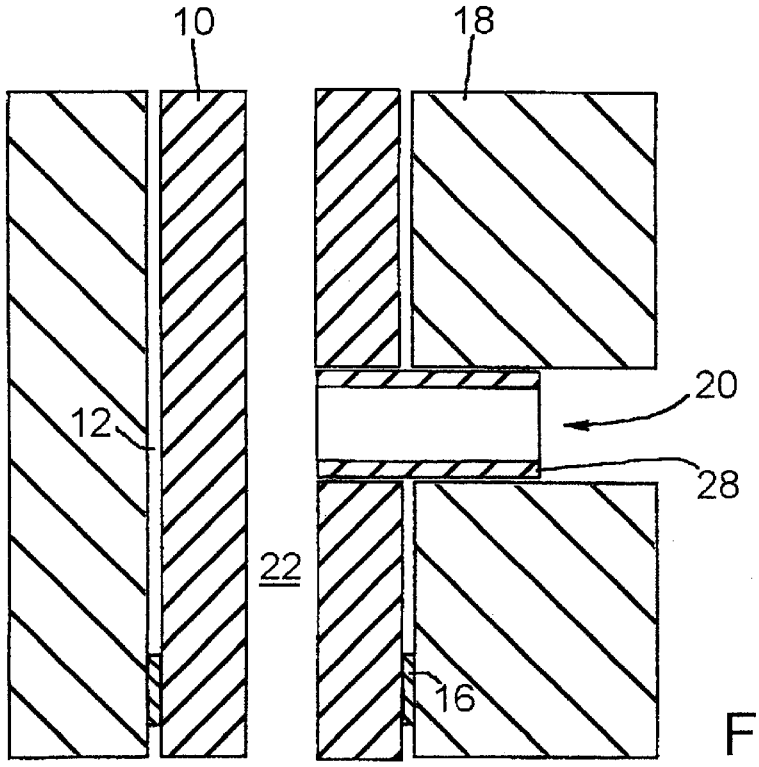
FIG. 3 corresponds to FIG. 2 but shows the tubing hanger landed, locked down and sealed to the spool.
Figure 4:
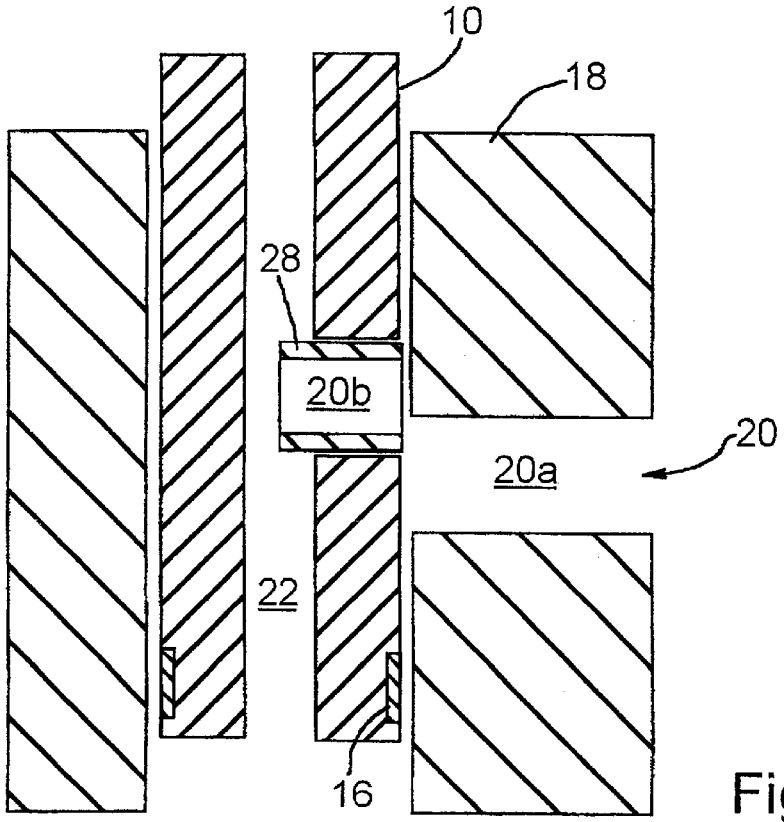
FIG. 4 corresponds to FIG. 2 but shows a second embodiment of the invention.
Figure 5:
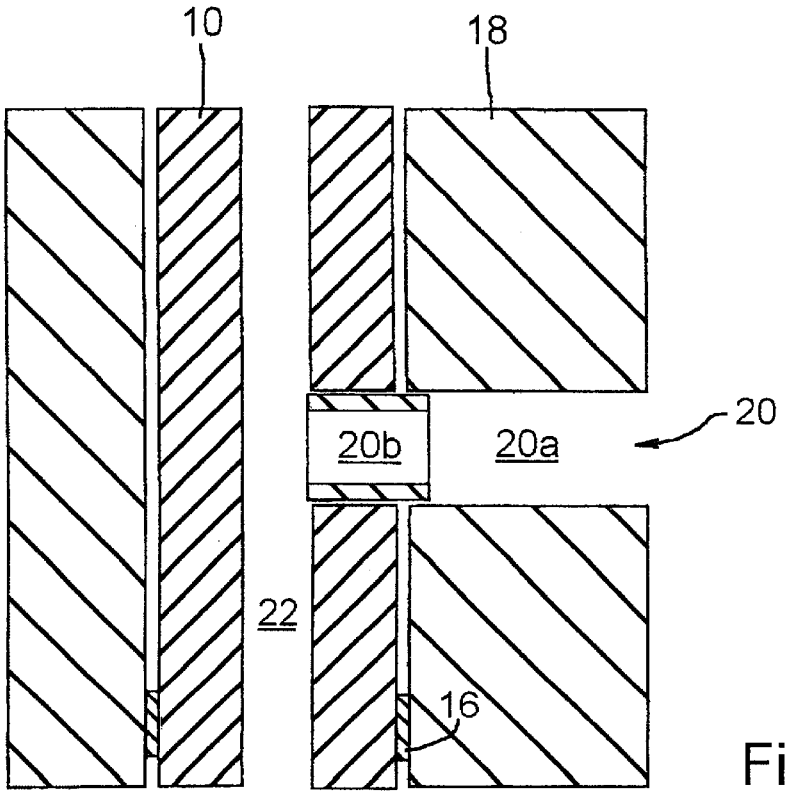
FIG. 5 corresponds to FIG. 3 but shows the second embodiment.

Two embodiments are described, one having the sealing sleeve located or stowed within the xmas tree or spool while running (FIGS. 2 and 3; suitable more for surface applications) and one with the sealing sleeve located within the tubing hanger (FIGS. 4 and 5; more suitable for subsea applications).

FIG. 2 shows the tubing hanger 10 being run into the xmas tree or spool 18. The sealing sleeve 28 is axially slideable in a lateral production fluid outlet conduit 20 comprising parts 20*a* and 20*b* extending through the spool 18 and tubing hanger 10, respectively. These parts are aligned when the tubing hanger is properly landed in the spool (FIG. 3). To allow the tubing hanger 10 to be run or retrieved, the sleeve 28 is withdrawn fully into the conduit part 20*a* in the spool 18 (FIG. 2), clear of the spool/tubing hanger interface. FIG. 3 shows the sealing sleeve 28 stroked so as to extend into the landed and locked tubing hanger 10.

The lower annular seal 16 (or a corresponding upper seal, not shown) may be run and set in known manner. For example, it may be run on the tubing hanger 10 and set prior to stroking the sleeve 28 to its sealed position.

The sleeve 28 is required to form a seal with an annular area or surface 30 of the conduit part 20*b* in the tubing hanger 10. It is likewise required to make an annular seal with the conduit part 20*a* in the spool 18. Conventionally, it is preferred that metal seals are used in the production bore. Therefore self-energizing metal seals as shown in FIG. 2*a* may be used between the sleeve 28 and the conduit parts 20*a,* 20*b*. The sleeve 28 may incorporate annular seal bumps 34, 36 which are transited from a clearance condition in the respective conduit parts 20*b,* 20*a,* to an interference fit in respective cylindrical seal areas 30, 32 by respective ramp surfaces 38, 40, as the sleeve 28 is moved to the left. For clarity, the slope of the ramp surfaces 38, 40 is shown somewhat exaggerated. Such a sealing arrangement is a development of the assignee's SBMS (straight bore metal seal) concept: see U.S. Pat. No. 4,471,965, the disclosure of which is incorporated herein by reference.

The nature of SBMS type seals dictates that surface finishes should be tightly controlled, and more significantly, concentricity of seals and bores should also be strictly controlled. In the FIG. 2 embodiment the tubing hanger must therefore be located accurately in altitude and rotation to allow the seal sleeve to locate correctly. This magnitude of installation accuracy is achievable, for example already being routine in relation to the use of horizontal penetrators. Elastomeric and other seal types may also be used to provide the annular seals between the sleeve 28 and the conduit parts 20*a,* 20*b*.

The sleeve 28 can be stroked between its retracted and extended positions by any suitable mechanical, electrical and/or hydraulic means, well known to those familiar with valve and/or oilfield technology. Because the sleeve 28 extends from the body of the spool 18, which in turn is accessible exteriorly (e.g., for manual actuation of the sleeve), the embodiment shown in FIGS. 2 and 3 is best suited for surface use. The relatively long conduit part 20*a* accommodates a relatively long sleeve 28 and sleeve operating stroke.

In the embodiment shown in FIG. 4, the sleeve 28 is held within the conduit part 20*b* in the tubing hanger 10, for running and retrieval of the tubing hanger and completion. FIG. 5 shows the sleeve 28 stroked outwardly into the conduit part 20*a* in the spool.

In this embodiment the tubing hanger 10 must again be located accurately vertically and in rotation to allow the sealing sleeve 28 to locate correctly. However, in this case it may be possible to utilize the sleeve to "fine align" the tubing hanger prior to lockdown. For this purpose, the sleeve 28 and/or the conduit part 20*a* may have suitable tapering guide surfaces at their mating ends. The same fine alignment technique can be used in relation to a variant of the FIGS. 2 and 3 embodiment, provided that the hanger is locked down and the annular seal is set between it and the spool after such alignment. For example, the tubing hanger/spool annular seal may be installed above the lateral conduit 20.

The sleeve 28 of FIGS. 4 and 5 can again be stroked into position by any suitable mechanical, electrical or hydraulic actuating means. As such actuating means are contained in the tubing hanger and/or the tubing hanger running tool, this embodiment is more suitable for subsea use. In other respects, the embodiment of FIGS. 4 and 5 is similar to the embodiment of FIGS. 2 and 3.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. A wellhead system comprising a fluid conduit which extends laterally at least partially through a tubing hanger and a surrounding spool, the system comprising a sleeve which is slideable axially within the fluid conduit from a position in which the sleeve is clear of an interface between the tubing hanger and the spool to a position in which the sleeve forms a seal across the interface.

2. A wellhead system as defined in claim 1, further comprising a recessed sealing profile within the spool with which the sleeve co-operates to form the seal across the interface.

3. A wellhead system as defined in claim 1, wherein the sleeve is stowable in the spool for running or retrieval of the tubing hanger.

4. A wellhead system as defined in claim 1, wherein the sleeve is stowable in the tubing hanger for running or retrieval of the tubing hanger.

5. A wellhead system as defined in claim 1, further comprising a single annular seal between the tubing hanger and the spool.

6. A wellhead system as defined in claim 1, wherein the sleeve comprises an SBMS-type seal which is adapted to engage the spool and/or the tubing hanger to form the seal across the interface.

7. A wellhead system as defined in claim 1, wherein the sleeve comprises an elastomeric seal which is adapted to engage the spool and/or the tubing hanger to form the seal across the interface.

* * * * *